US008505259B1

(12) United States Patent
Degtyarev

(10) Patent No.: US 8,505,259 B1
(45) Date of Patent: Aug. 13, 2013

(54) BUILT-UP DEEP DECK UNIT FOR A ROOF OR FLOOR

(75) Inventor: Vitaliy V. Degtyarev, Columbia, SC (US)

(73) Assignee: Consolidated Systems, Inc., Columbia, SC (US)

( * ) Notice: Subject to any disclaimer, the term of this patent is extended or adjusted under 35 U.S.C. 154(b) by 0 days.

(21) Appl. No.: 12/856,033

(22) Filed: Aug. 13, 2010

Related U.S. Application Data

(60) Provisional application No. 61/243,301, filed on Sep. 17, 2009.

(51) Int. Cl.
*E04H 12/00* (2006.01)

(52) U.S. Cl.
USPC ..... 52/650.1; 52/843; 52/177

(58) Field of Classification Search
USPC ..... 52/177, 800.1, 800.13, 800.12, 843, 52/847, 836, 844, 650.1, 650.3
See application file for complete search history.

(56) References Cited

U.S. PATENT DOCUMENTS

| | | | | | |
|---|---|---|---|---|---|
| 2,082,792 | A * | 6/1937 | Dean | 52/839 |
| 3,397,497 | A * | 8/1968 | Shea et al. | 52/334 |
| 4,685,264 | A | 8/1987 | Landis | |
| 5,172,527 | A | 12/1992 | Ault | |
| 5,205,098 | A * | 4/1993 | Landis et al. | 52/336 |
| 5,259,157 | A | 11/1993 | Ault | |
| 5,791,100 | A * | 8/1998 | Schieferly et al. | 52/177 |
| 5,930,963 | A * | 8/1999 | Nichols | 52/239 |
| 6,357,191 | B1 | 3/2002 | Ault et al. | |
| 6,691,482 | B1 * | 2/2004 | Ault | 52/450 |
| 7,146,920 | B1 | 12/2006 | Ryan et al. | |
| 7,251,919 | B2 * | 8/2007 | Ray | 52/844 |
| 7,328,667 | B1 | 2/2008 | Ryan et al. | |
| 7,407,219 | B2 * | 8/2008 | Glasgow et al. | 296/187.03 |
| 7,418,807 | B1 | 9/2008 | Ryan et al. | |
| 7,603,814 | B1 | 10/2009 | Hartmann et al. | |
| 7,891,155 | B2 * | 2/2011 | Surowiecki | 52/842 |
| 2002/0088194 | A1 * | 7/2002 | Ray | 52/439 |
| 2009/0049781 | A1 * | 2/2009 | Pilz et al. | 52/481.1 |

* cited by examiner

*Primary Examiner* — Branon Painter
(74) *Attorney, Agent, or Firm* — Michael A. Mann; Nexsen Pruet, LLC

(57) ABSTRACT

A deck unit is disclosed to form a deck system for a roof or floor that is capable of supporting a heavier load and/or spanning greater distances. The deck unit is a profiled, metal unit, that derives its greater load-bearing strength in part from its greater depth but provides flexibility in achieving the greater strength from the way the additional depth is obtained. In particular, a full length channel is attached to a hat-shaped profile. The channel adds strength both by increasing deck unit depth and by avoiding lengthening the webs on the hat-shaped profile. The channel increases design flexibility by allowing the designer to increase the strength of pre-existing decks by the addition of a channel of suitable metal thickness and size. It also provides a channel for conduit, cabling and wiring. The deck unit may be fluted or, by the addition of a liner panel to close the interior of hat-shaped profile, cellular. Sound absorbing materials can be installed in either a fluted or cellular deck unit.

16 Claims, 9 Drawing Sheets

BUILT-UP DEEP DECK UNIT FOR A ROOF OR FLOOR

PRIORITY CLAIM

The priority benefit of U.S. provisional patent application Ser. No. 61/243,301 is claimed which was filed Sep. 17, 2009, and which is incorporated herein in its entirety by reference.

BACKGROUND OF THE INVENTION

A roof or floor may be constructed by fastening metal deck units together to form a deck system. The deck system may then serve as a roof or a floor, or may be covered with a layer of concrete to form a composite structure. For some applications, such as airports, stadiums, sports arenas, convention centers, schools and other large, open areas, a deck system may include sound-absorbing materials.

The ability of a deck system to support its design load is the most critical consideration. The design load for a roof begins with the weight of the roof itself and may vary with local environmental conditions, such as, for example, snow, ice and wind loads. Likewise, the design loads for floor applications vary by the use and location of the building. The strength of a deck system comes from its geometry, the choice of construction materials, and how those materials are formed, are connected and cooperate with each other and with other structural materials in the building. Finally, a deck system must be economical and its components easily manufactured, efficiently transported and simply and quickly installed at the job site. Designing an economical and practical roof or floor deck unit capable of supporting the design load presents a challenge.

Thus there is a continuing need for improvements in the design of deck units, particularly those that are designed for greater strength for a given amount of materials while remaining cost-effective.

SUMMARY OF THE INVENTION

The present invention is a deck unit for use in forming a deck system capable of supporting heavier loads and/or spanning greater distances. The deck unit of the present invention is a profiled metal unit that derives its greater load-bearing strength in part from its greater depth and in part from the way the additional depth is obtained. In particular, the additional depth and strength is accomplished by attaching a full length channel to the top of a hat-shaped profile. Adding a channel to the profiled deck unit to obtain additional strength not only provides greater strength but also increases flexibility in the design and manufacture of deck units.

The present deck unit may comprise a hat-shaped profile with a top flange supported by two opposing webs, with a channel bearing on or nested with on the hat-shaped profile. The deck unit may be fluted or, optionally, the deck unit may include a liner panel to define a cellular deck unit. In alternative embodiments, the liner panel may be perforated and a deck unit may include sound absorbing material in the interior of the hat-shaped profile of the deck unit. Alternatively, webs and/or top flange of a fluted deck unit may be perforated and may include acoustical material between the hat sections and/or in the interior of the channel.

The present deck unit has advantages in its ability to support considerably greater design loads with relatively little additional material. Its strength and its design flexibility derive from the channel bearing on or nested with the hat-shaped profile rather than in simply forming a deeper hat-shaped profile. The hat-shaped profile can be the same dimensions for many different roof design conditions but the size and gauge of the channel can be varied to adjust the overall deck's strength and stiffness.

Another advantage of the present invention is that, whether in cellular or fluted form, the channel itself can serve as an unobstructed and protected conduit for running cable, wiring or piping. The cellular and fluted deck units can additionally support sound-absorbing materials.

The features and advantages of the present invention will be readily apparent to those skilled in the art of steel deck systems for roofs and floors from a careful reading of the Detailed Description of Preferred Embodiments, accompanied by the following drawings.

BRIEF DESCRIPTION OF THE DRAWINGS

In the figures.

DETAILED DESCRIPTION OF EMBODIMENTS

The present invention is a deck unit suitable for supporting heavy design loads and/or spanning greater distances. The present deck unit is made of sheet metal and has a profile that allows it to be joined to other similar deck units in order to form a deck system that supports a specified design load. The present deck system may be used as a roof or a floor; it may be combined compositely with concrete for added strength, and it may include acoustic features for those applications where noise reduction is desired. Acoustic features are structures and materials that absorb sounds or facilitate the absorption of sounds.

In the present specification, the word deck refers to a small group of deck units, such as one, two or three deck units, that can be manufactured, handled and delivered as an assembly, and thus deck systems can be made by combining a sufficient number of individual deck units or multi-deck-unit decks or combinations thereof. The deck units may be cellular or fluted; that is, when the deck units include a liner panel, the liner panel defines a cell with the deck unit above it. If there is no liner panel, the deck units are said to be fluted.

Figure 1:
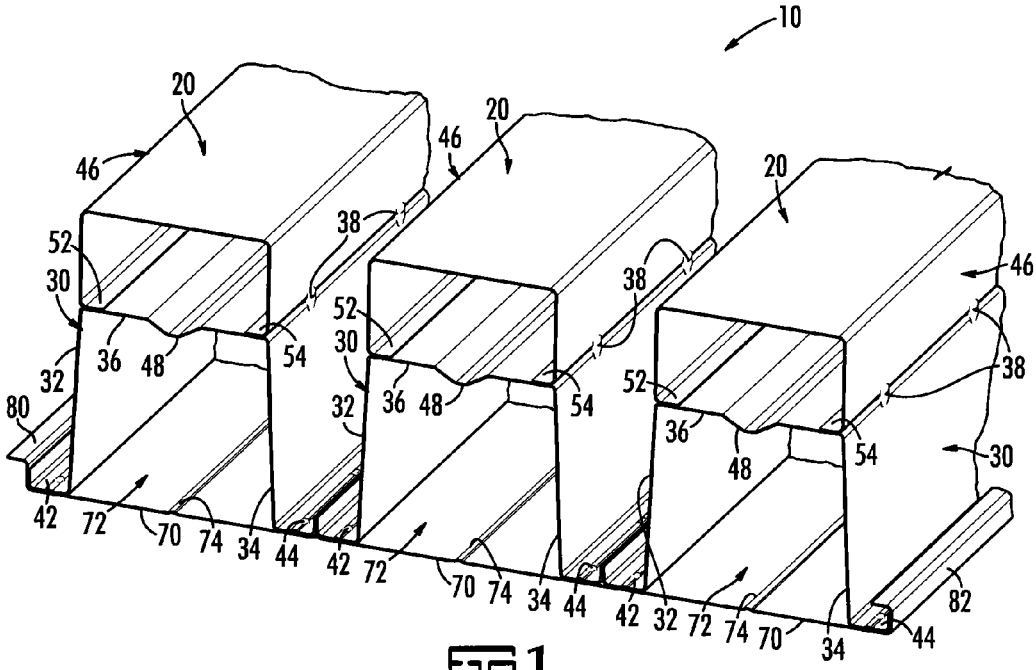
FIG. 1 is a perspective view of a portion of a deck, according to the present invention.

Referring now to a first preferred embodiment of the present invention, illustrated in FIG. 1, there is shown a deck 10 according to the present invention, made of three cellular deck units 20. Deck 10 may be joined to other decks 10 or deck units 20, or combinations of decks 10 and deck units 20 to form a deck system. Plural decks 10 are joined by any convenient means including welding, crimping, riveting or using self-drilling fasteners, or a combination of these, to form a deck system of the desired dimensions and shape. A framework, not shown, may support a deck system.

After deck units 20, or decks 10, are joined to form a deck system, the system may be covered with a layer of concrete to form a composite structure. Additional material layers may also be applied.

Each deck unit 20 has a hat-shaped profile 30 comprising two opposing webs 32, 34 that are integrally joined to a top flange 36 to define a shape that is roughly an upside-down U, when viewed from the end. Lengthwise, webs 32, 34, and top flange 36 extend the full length of a span which defines the major dimension of deck unit 20. Laterally, webs 32, 34, terminate in integrally-formed, opposing, bottom flanges identified by reference numbers 44 and 42, respectively. A box-like channel 46 is attached to hat-shaped profile to increase the height of deck unit 20. Channel 46 is characterized by a generally flat top with or without stiffeners, straight sides may or may not be bent at 90 degrees with respect to the flat top and terminal portions of the sides that may or may not be bent inwardly. The top and two sides at angles to the top define the box-like shape. Channel 46 is attached to top flange 36 or to webs 32, 34, preferably by weldments 38.

One measure of the load-bearing capability of a deck unit 20 is its depth: generally, the greater the depth, the greater the load-bearing capability of the deck. Depth is measured from the top of channel 46 to the bottom of bottom flanges 42, 44. To increase further the overall depth of deck unit 20, hat-shaped profile 30 and/or channel 46 may be made deeper.

Channel 46 is not integrally formed with hat-shaped profile 30 but formed from a separate sheet of metal and attached to hat-shaped profile 30, preferably by weldments 38. This is an important feature of the present invention as channel 46 not only increases the depth of deck unit 20 without increasing the height of first and second webs 32, 34, and thus its load-bearing capability, but does so in a way that provides flexibility in designing deck unit 20. For example, the thickness of channel 46 can be selected to provide sufficient strength for deck unit 20, a little thicker for a stronger deck unit 20, a little thinner for a deck unit 20 that is a little less strong. For another example, the gauge of metal of which channel 46 is made does not have to be the same gauge as hat-shaped profile 30 is made, thus allowing, for example, the use of a thicker gauge for channel 46 when additional strength is needed for deck system 10 or for a particular portion of deck system 10. Therefore, the same hat-shaped profile 30 can be used with different gauges of metal for channels 46 when deck units 20 of different strengths are needed rather than having to produce entirely different deck units 20, as only channel 46 needs to be different.

Channel 46 in FIG. 1 is shown being carried on hat-shaped profile 30. In this configuration, channel 46 is bent in the form of an open box-like shape with at least two rounded corners and terminal portions 52, 54 that are attached, spaced-apart, to top flange 36. Terminal portions 52, 54, of channel 46 are fastened to top flange 36 preferably by weldments 38 at intervals along the length of deck unit 20. Self-drilling fasteners and rivets can also be used.

Topographic or structural features may be added to the components of deck 10 to improve stiffness. Top flange 36 (or channel 46), for example, may be formed to have a trough 48 parallel to the major axis of deck unit 20 for increased stiffness. Webs 32, 34 are canted so as to be closer together at top flange 36 than at bottom flanges 42, 44. Bottom flanges 42, 44, may have stiffeners 60, 62 such as beads. Stiffeners may be added not only for strength but also for preventing misalignment and shape distortion during manufacturing. Stiffness can also be added by incorporating struts at intervals within and along hat-shaped profile, The dimensions of these features are determined by sound engineering principles and a modest amount of experimentation, along with considerations of cost.

Deck 10 may also include a liner panel 70 that encloses the interior 72 of hat-shaped profile 30 of deck unit 20. Liner panel 70 may have a bead 74 running parallel to the long dimension of deck unit 20, for strength but also, in particular, so that liner panel 70 remains flat across interior 72 for a more uniform appearance across a deck system when it is used as a ceiling or roof.

Liner panel 70 has a first bottom flange 80 and an opposing second bottom flange 82. First bottom flange 80 and second bottom flange 82 nest, that is, each bottom flange is formed to have one or more faces at angles with respect to each other, so that, when first bottom flange 80 of a liner panel 70 of a deck 10 is brought into engagement with a second bottom flange 82 of a panel 70 of an adjacent deck unit, a first bottom flange 80 receives second bottom flange 82 within it (or vice versa) thereby to allow the corresponding faces of first bottom flange 80 to be brought into parallel and close relationship with the faces of second bottom flange 82 so that first and second bottom flanges 80, 82 may be joined by convenient means, such as clinching, welding, riveting, using self-drilling fasteners, or combinations thereof. Bottom flanges 42, 44 of each deck unit 20 are fastened to liner panel 70 preferably by welding.

Figure 2:
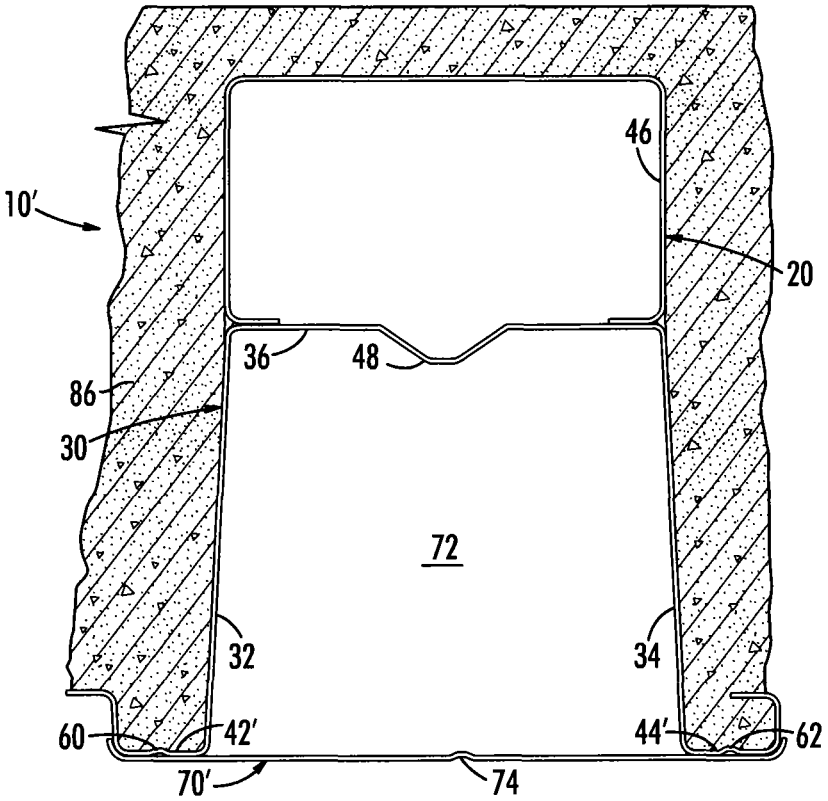
FIG. 2 is an end view of a cellular deck unit with a channel attached to the hat-shaped profile supporting a layer of concrete, according to the present invention.
Figure 3A:
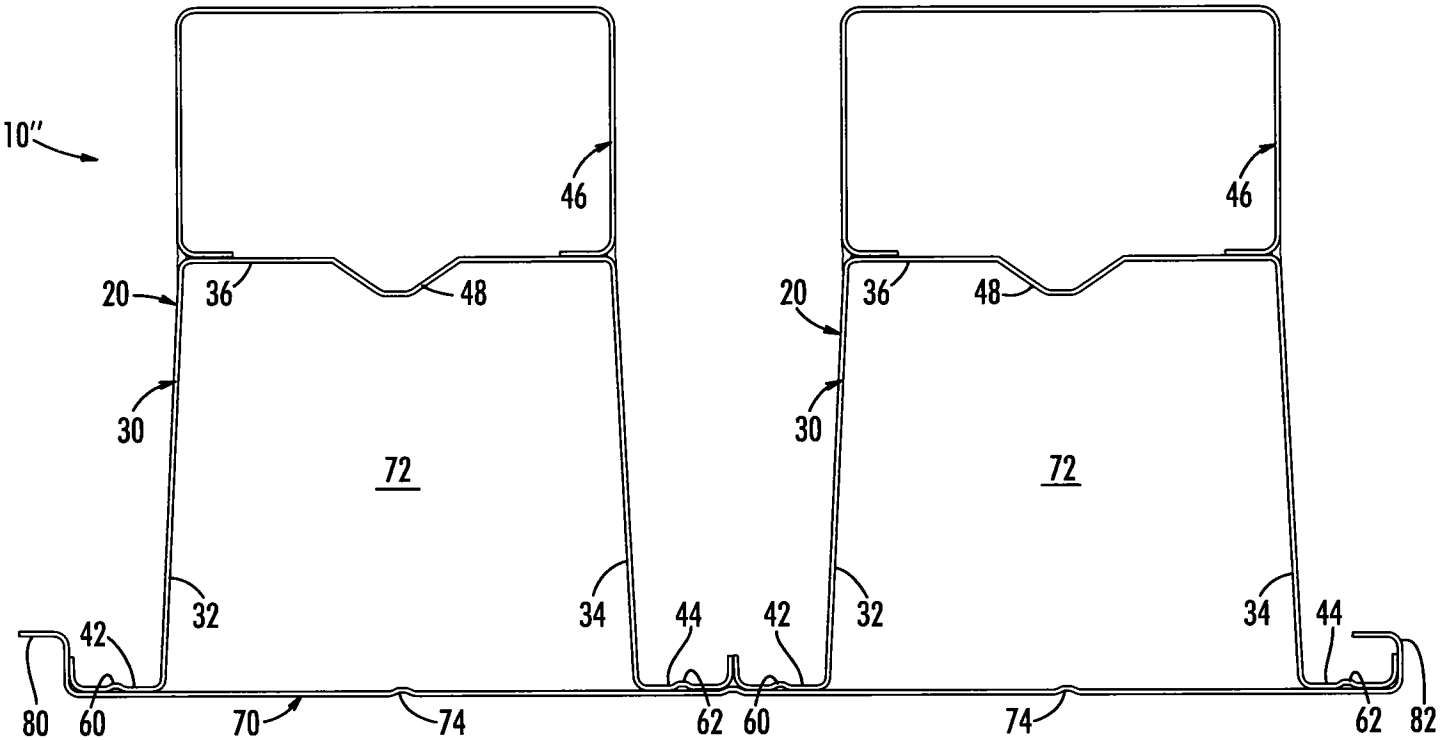
FIG. 3A is an end view of a cellular deck unit with channels attached to each hat of a two-hat-shaped profile, according to the present invention.
Figure 3B:
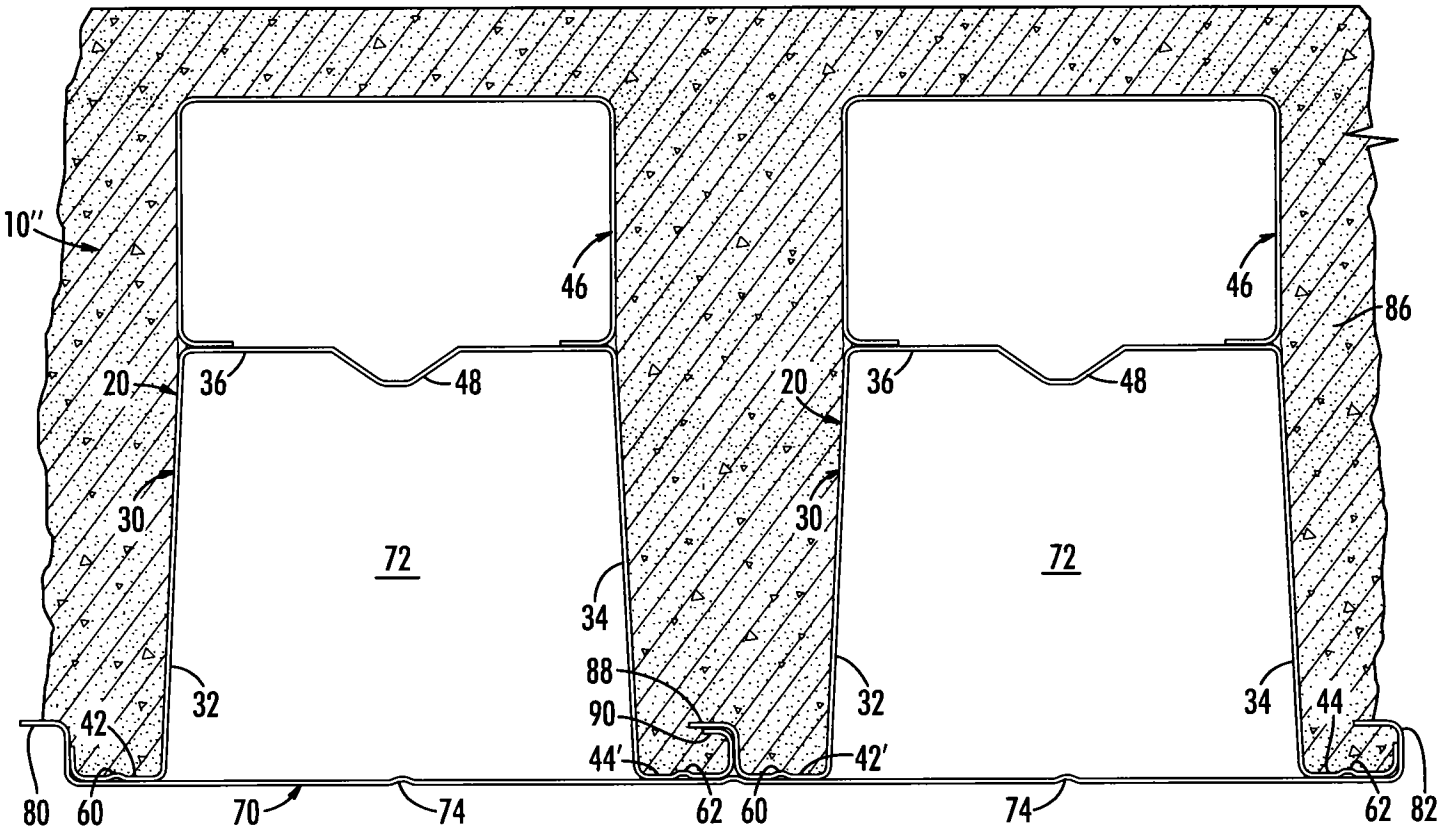
FIG. 3B is an end view of a cellular deck unit with channels attached to each hat of a two-hat-shaped profile supporting a layer of concrete, according to the present invention.

FIGS. 2 and 3A and 3B illustrate other embodiments of the present invention. The use of the same reference numbers in FIGS. 2 and 3A and 3B indicates the structures are the same and serve the same function.

FIG. 2 shows a deck 10' made of a single cellular deck unit 20 with a hat-shaped portion 30 with webs 32, 34 and a top flange 36. A channel 46 is carried on top flange 36 and a panel liner 70 encloses the space 72 inside hat-shaped portion 30. Webs 32, 34 terminate in bottom flanges 42', 44', and panel liner 70' is flat except for a bead 84. A layer of concrete 86 lies over deck 10'.

FIG. 3A illustrates a deck 10" made with two cellular deck units 20, each with a hat-shaped portion 30 with webs 32, 34 and a top flange 36. A channel 46 is carried on top flange 36 and a panel liner 70 encloses the space 72 inside hat-shaped portion 30. Webs 32, 34 terminate in bottom flanges 42, 44, and liner panel 70 includes a bead 74 as well as two bottom flanges 80, 82.

FIG. 3B illustrates a deck 10" made with two cellular deck units 20, each with a hat-shaped portion 30 with webs 32, 34 and a top flange 36. A channel 46 is carried on top flange 36 and a panel liner 70 encloses the space 72 inside hat-shaped portion 30. Webs 32, 34 terminate in bottom flanges 42, 42', 44, 44', and liner panel 70 includes a bead 74 as well as beads 60, 62 on two bottom flanges 80, 82. A layer of concrete 86 lies over deck 10". Bottom flanges 42', 44' extend vertically and then bend to terminate in horizontal flanges 88, 90 so that bottom flanges 42', 44' nest with each other to act compositely with concrete 85

Figure 4:
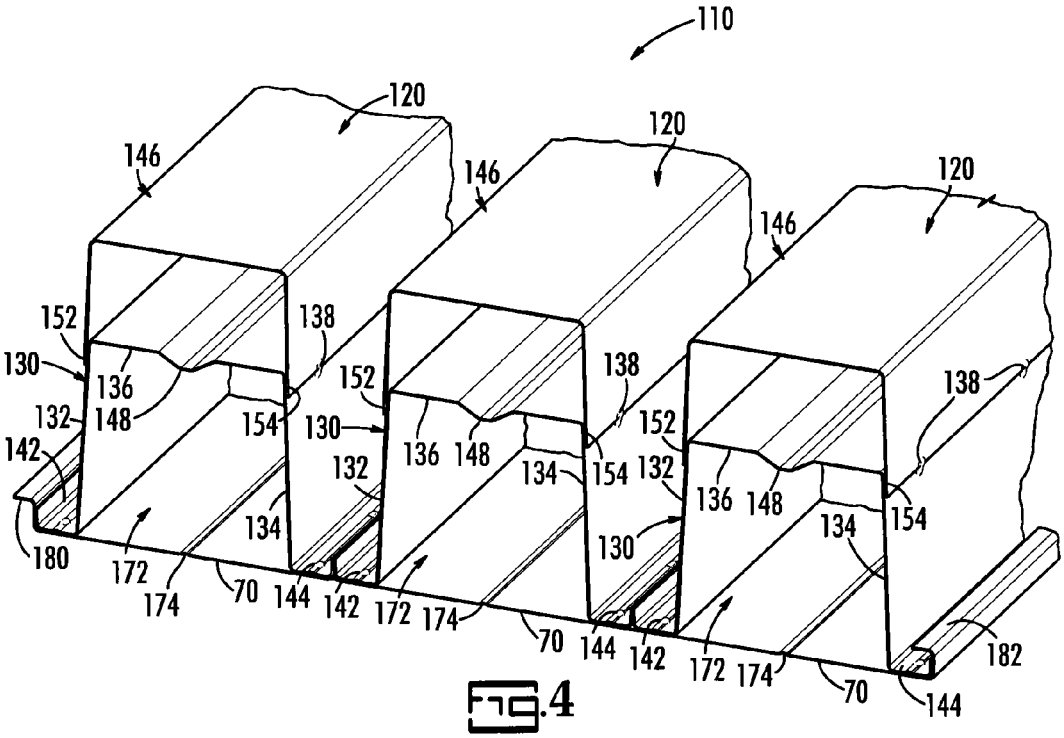
FIG. 4 is a perspective view of a portion of a deck with channels nested on the hat-shaped profiles, according to the present invention.
Figure 5:
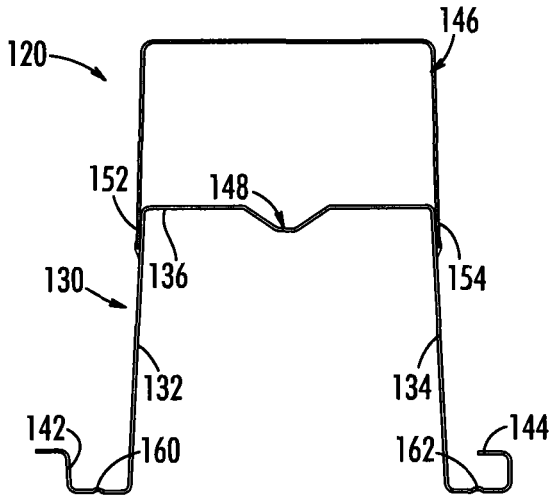
FIG. 5 is an end view of a fluted deck unit with a channel nested with the hat-shaped profile, according to the present invention.
Figure 6:
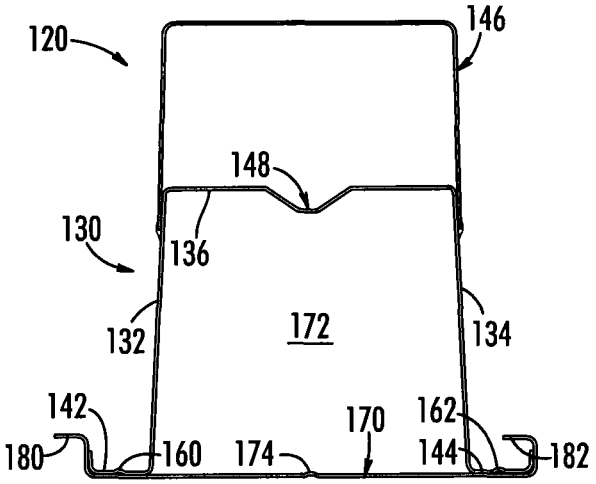
FIG. 6 is an end view of a cellular deck unit with a channel nested with the hat-shaped profile, according to the present invention.

FIGS. 4-6 illustrate an alternative preferred embodiment of the present invention similar to that shown in FIGS. 1-3. FIG. 4 illustrates a deck 110 made of three deck units 120. As with deck 10, plural decks 110 can be joined to form a deck system to serve as a floor or roof. Each deck unit 120 has a hat-shaped profile 130 with webs 132, 134 integrally formed with a top flange 136 and terminating laterally in opposing bottom flanges 142, 144.

Each deck 120 also has a channel 146 similar to channel 46 of FIGS. 1-3, in that channel 146 is a separate but integral component, and is attached to hat-shaped profile 130 and channel 146 is also shaped like an open box. However, channel 146 rather than terminating in inwardly folded terminal portions 52, 54 to allow channel 46 to bear on top flange 36 of hat-shaped profile 30 as shown in FIG. 1, channel 146 has terminal portions 152, 154 that are not folded but are attached to webs 132, 134 of hat-shaped profile 130 preferably by weldments 138 in an overlapping and nested arrangement.

Deck 110 is shown in FIG. 4 and deck unit 120 is shown in FIG. 6 as having a liner panel 170 to enclose an interior 172 of hat-shaped profile 130. Liner panel 170 has a first bottom flange 180 and an opposing second bottom flange 182 (and bead 174) that, as with first and second bottom flanges 80, 82 of FIG. 1, are formed to have faces that nest, that is, the faces of first bottom flange 180 are formed and dimensioned to receive the corresponding faces of second bottom flange 182 in parallel and close proximity so that two decks 110 can be placed side by side and fastened together. Any convenient means of fastening, including welding, clinching, riveting and using self-drilling fasteners, and combinations thereof may be used.

Bottom flanges 142, 144, of each deck unit 120 are fastened to liner panel 170, preferably by welding. The use of panel 170 creates a cellular structure for deck units 120 that is strong and accommodates sound-absorbing materials within interiors 172.

Channel 146, in addition to providing increased depth for deck unit 120, also provides a protected and convenient conduit for cabling, wiring and piping, allowing a way to run cabling, etc., through deck 110, where it is hidden from view and protected.

Channels 46 and 146 do not require uniform cross-sectional area from one end of a deck unit 20, 120, respectively, to the other but can have a depth that varies from one end to the other, assuming the loading varies from one end to the other or other design requirements dictate a varying depth of deck system along its length. Under these circumstances, the present channel-on-hat-profile configuration offers yet additional design flexibility.

Deck units 120 may include features that increase stiffness, such as trough 148 in top flange 136 (or a similar trough in channel 146), stiffeners 160 and 162 in bottom flanges 142, 144, respectively, and bead 174 in liner panel 170.

Figure 7:
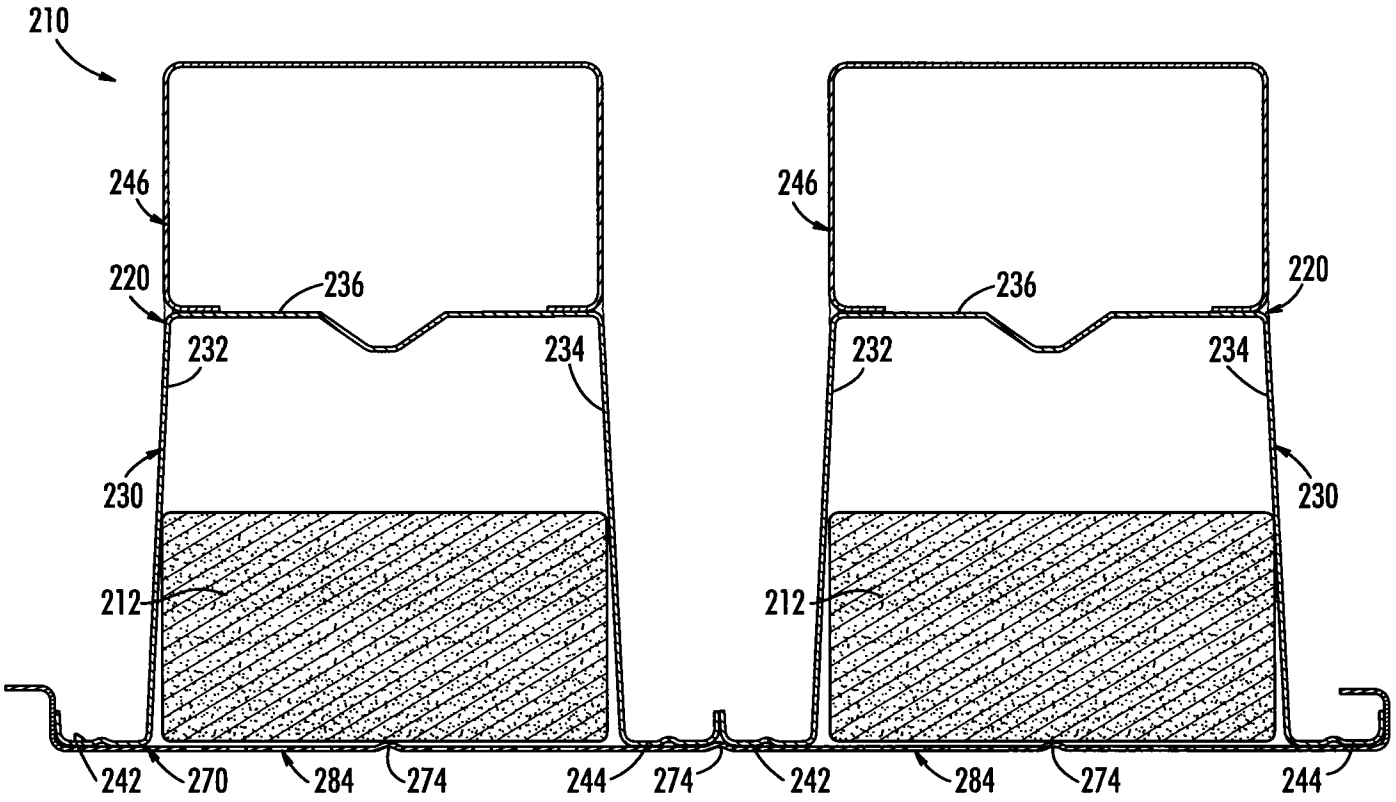
FIG. 7 is an end view of a cellular deck unit with a channel bearing on the hat-shaped profile with a perforated liner panel and sound-absorbing material carried in the hat-shaped profile, according to the present invention.

FIG. 7 illustrates a deck 210 with sound absorbing materials 212. Deck 210 comprises two cellular deck units 220, each with a hat-shaped profile 230 that includes webs 232, 234 and a top flange 236. A channel 246 is attached to hat-shaped profile 230. Webs 232, 234 terminate in bottom flanges 242, 244, respectively. A liner panel 270 defines a space 272 within hat-shaped profile 230. Liner panel 270 is perforated with an array of holes 284 and beads 274. Within space 272 is sound-absorbing materials 212. Sound enters space 272 through holes 284 and is absorbed by sound absorbing materials 212 in space 272.

Figure 8:
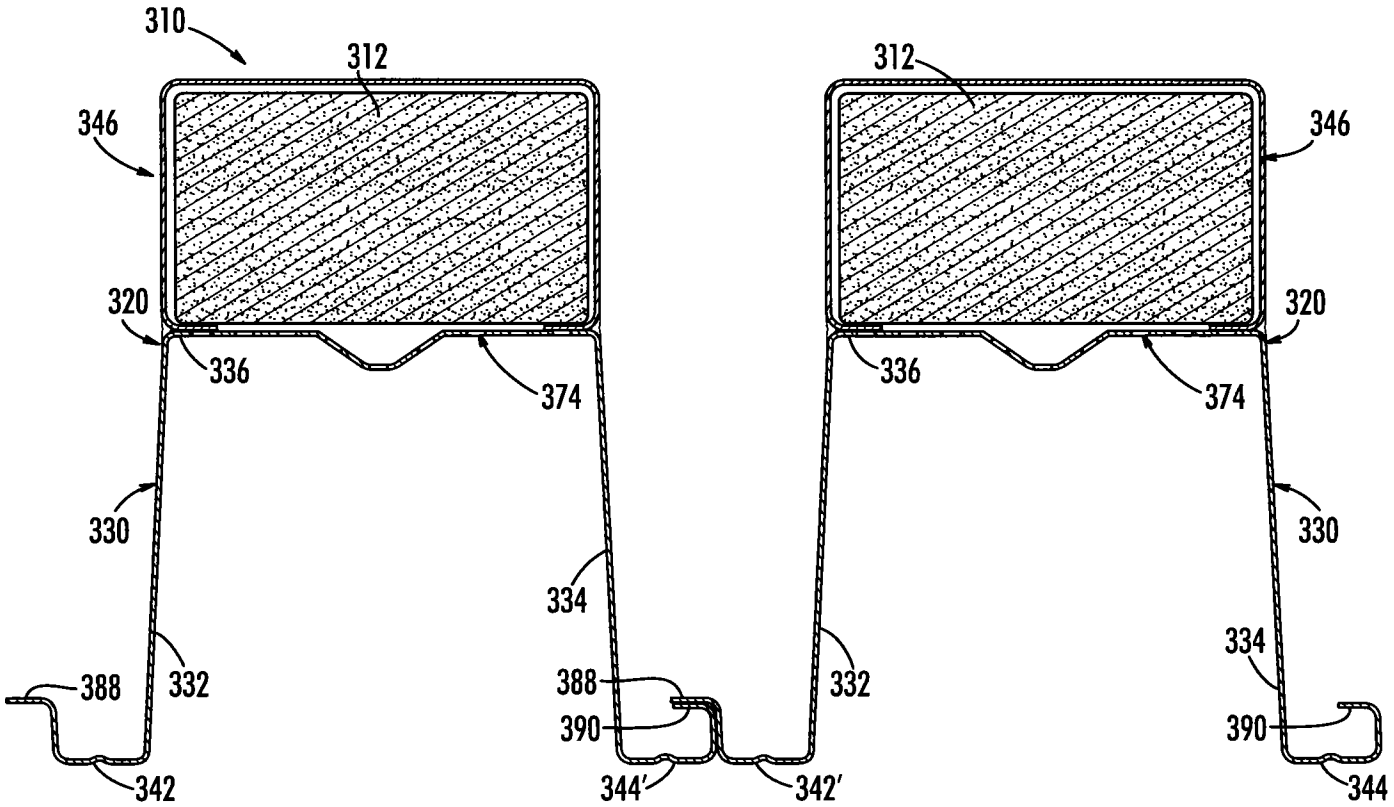
FIG. 8 is an end view of a fluted deck unit with a channel bearing on the hat-shaped profile with a perforated top flange and sound-absorbing material carried in the channel, according to the present invention.

FIG. 8 illustrates another deck 310 with sound absorbing materials 312. Deck 310 comprises two fluted deck units 320, each with a hat-shaped profile 330 that includes webs 332, 334 and a top flange 336. A channel 346 is attached to hat-shaped profile 330. Webs 332, 334 terminate in bottom flanges 342, 344', 342', 344, respectively. Top flange 336 is perforated with an array of holes 374. Within channel 346 is sound-absorbing materials 312. Sound enters hat-shaped profiles 330, passes through holes 374 into channel 346 where it is absorbed by sound absorbing materials 312. Bottom flanges 342', 344' extend vertically and then bend to terminate in horizontal flanges 388, 390 so that bottom flanges 342', 344' nest with each other.

Figure 9:
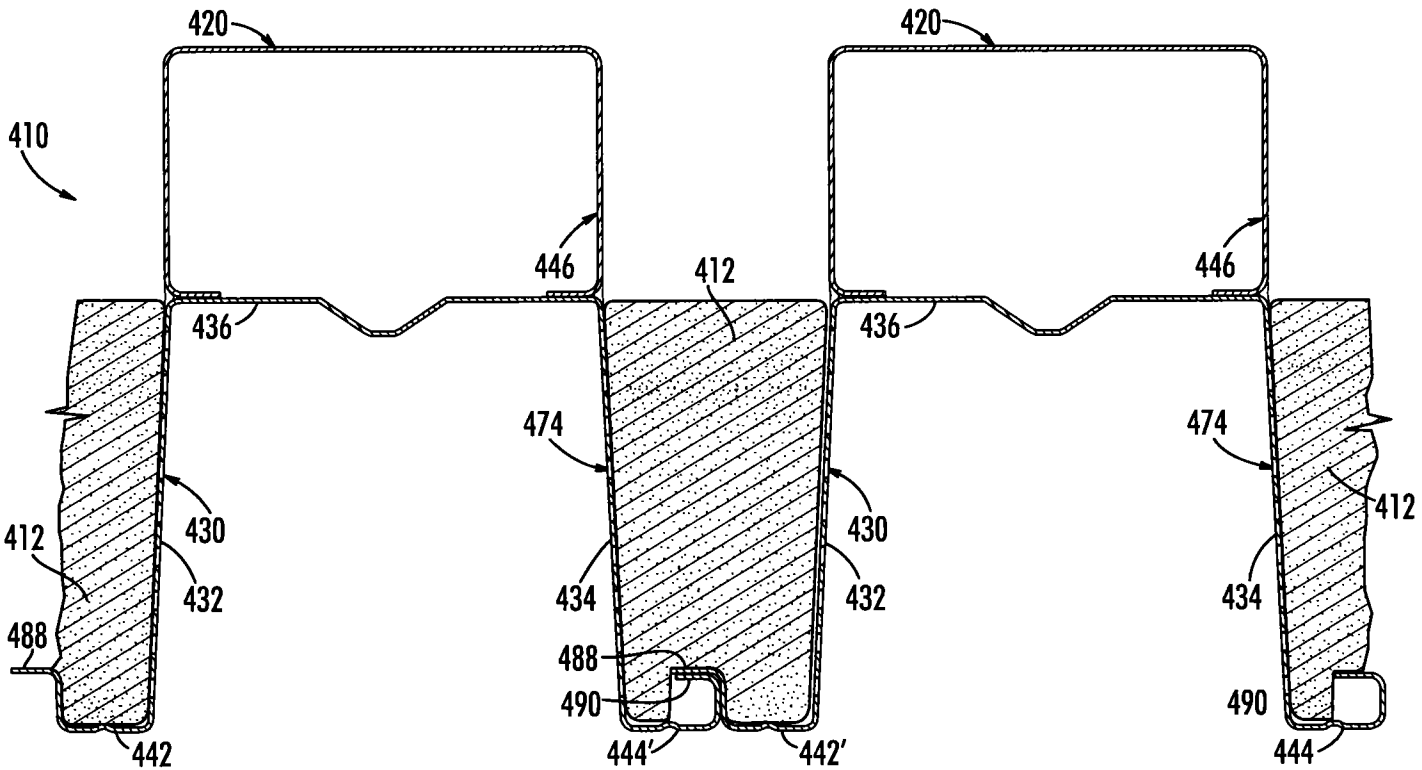
FIG. 9 is an end view of a cellular deck unit with a channel bearing on the hat-shaped profile with perforated webs and sound-absorbing material carried adjacent to the hat-shaped profile, according to the present invention.

FIG. 9 illustrates yet another deck 410 with sound absorbing materials 412. Deck 410 comprises two fluted deck units 420, each with a hat-shaped profile 430 that includes webs 432, 434 and a top flange 436. A channel 446 is attached to hat-shaped profile 430. Webs 432, 434 terminate in bottom flanges 442, 442', 444' 444, respectively. Webs 432, 434, 436 are perforated with an array of holes 474. Between fluted deck units 420 are sound-absorbing materials 412. Sound enters hat-shaped profiles 430 and proceeds through holes 474 in webs 432, 434, and is absorbed by sound absorbing materials 412 between deck units 420. Bottom flanges 442', 444' extend vertically and then bend to terminate in horizontal flanges 488, 490 so that bottom flanges 442', 444' nest with each other.

It will be clear to those familiar with deck systems that the arrangements of sound-absorbing materials shown in FIGS. 8 and 9 can of course be combined and the arrangements of sound-absorbing materials in FIGS. 7 and 8 can also include a layer of concrete as illustrated in FIG. 3B.

Those familiar with the use of steel decks in constructing floors and ceilings will appreciate that many modifications and substitutions can be made to the foregoing preferred embodiments of the present invention without departing from the spirit and scope of the present invention, defined by the appended claims.

What is claimed is:

1. A deck unit for use in constructing a roof or floor of a building, said deck unit comprising:

a hat-shaped profile having a top flange and two opposing webs, each web of said two opposing webs having a bottom flange, said hat-shaped profile being made of sheet metal formed to have said hat-shaped profile; and a box-like channel having at least two corners, a top between said two corners, and two opposing sides, said box-like channel contacting a top portion of said hat-shaped profile and supported by said webs of said hat-shaped profile to define a deck unit, said box-like channel being made of sheet metal formed to have a box-like profile, said box-like channel being supported by said hat-shaped profile to add depth to said hat-shaped profile, and wherein said bottom flange of said each web of said hat-shaped profile is joinable to a bottom flange of a web of an adjacent hat-shaped profile so that plural deck units are connectable to form a deck system for a roof or a floor.

2. The deck unit as recited in claim 1, wherein said deck unit further comprises a liner panel attached to said hat-shaped profile to define a cellular deck unit.

3. The deck unit as recited in claim 2, wherein said liner panel is perforated.

4. The deck unit as recited in claim 2, wherein said hat-shaped profile carries sound-absorbing materials.

5. The deck unit as recited in claim 1, wherein said webs are perforated.

6. The deck unit as recited in claim 1, wherein said top flange is perforated.

7. The deck unit as recited in claim 1, wherein said webs and said top flange are perforated.

8. The deck unit as recited in claim 1, further comprising stiffeners carried by said webs.

9. The deck unit as recited in claim 1, further comprising stiffeners carried by said top flange.

10. The deck unit as recited in claim 1, wherein said box-like channel has inwardly terminating terminal portions, and wherein said terminal portions are fastened to said top flange.

11. The deck unit as recited in claim 1, wherein said box-like channel has opposing terminal portions, and wherein said terminal portions are fastened to said opposing webs.

12. The deck unit as recited in claim 1, wherein said box-like channel is made of a first gauge of steel and said hat-shaped profile is made of a second gauge of steel, said first gauge of steel being a different gauge of steel than said second gauge of steel.

13. The deck unit as recited in claim 1, wherein said box-like channel has a cross-sectional area and a first end and an opposing second end, and said cross-sectional area varies from said first end to said second end.

14. The deck unit as recited in claim 1, further comprising sound-absorbing material carried within said box-like channel.

15. The deck unit as recited in claim 1, further comprising sound-absorbing material carried adjacent to and outside said hat-shaped profile.

16. The deck unit as recited in claim 1, further comprising sound-absorbing material carried within said box-like channel and adjacent to and outside said hat-shaped profile.

* * * * *